US009097490B2

(12) United States Patent
Tseng

(10) Patent No.: US 9,097,490 B2
(45) Date of Patent: Aug. 4, 2015

(54) ADAPTER FOR ATTACHING A DETACHABLE STOCK TO THE FIRING MECHANISM OF A FIREARM

(71) Applicant: Jui-Fu Tseng, Yilan (TW)

(72) Inventor: Jui-Fu Tseng, Yilan (TW)

(73) Assignee: STARJET Technologies Co., Ltd, Jintan (CN)

( * ) Notice: Subject to any disclaimer, the term of this patent is extended or adjusted under 35 U.S.C. 154(b) by 42 days.

(21) Appl. No.: 14/102,531

(22) Filed: Dec. 11, 2013

(65) Prior Publication Data

US 2015/0159977 A1 Jun. 11, 2015

(51) Int. Cl.
*F41C 23/00* (2006.01)

(52) U.S. Cl.
CPC ..... *F41C 23/00* (2013.01)

(58) Field of Classification Search
CPC ..... F41C 23/00; F41C 23/04; F41C 23/10; F41C 23/12; F41C 23/14
USPC ..... 42/71.01, 73, 75.01, 75.03, 90, 72
See application file for complete search history.

(56) References Cited

U.S. PATENT DOCUMENTS

| | | | | |
|---|---|---|---|---|
| 2008/0216380 | A1* | 9/2008 | Teetzel | 42/127 |
| 2011/0076095 | A1* | 3/2011 | Storch et al. | 403/322.4 |
| 2011/0167703 | A1* | 7/2011 | Deros | 42/90 |
| 2014/0196348 | A1* | 7/2014 | Samson et al. | 42/90 |

* cited by examiner

*Primary Examiner* — William Gilbert

(57) ABSTRACT

An adapter is provided with a rail having one end secured to a gunstock; a groove structure including a bottom groove, a forward socket, a transverse channel through the socket, a pin hole through the channel, and a bottom limit member; a lever pivotably secured to the groove structure; and a sliding member in both the channel and the socket and including a projection at one end, a shoulder adjacent to the projection, a receptacle at an other end, a spring in the receptacle, and a slot perpendicular to the receptacle and communicating therewith. The pin is through the pin hole and the slot to anchor the spring between the pin and the receptacle. In a locked state, the shoulder is in the socket to lock the rail in the groove, the other end of the sliding member is projected, and the projection is retracted into the channel.

1 Claim, 5 Drawing Sheets

ADAPTER FOR ATTACHING A DETACHABLE STOCK TO THE FIRING MECHANISM OF A FIREARM

BACKGROUND OF THE INVENTION

1. Field of the Invention

The invention relates to adapters and more particularly to an adapter for attaching a detachable stock to the firing mechanism and the barrel of a firearm.

2. Description of Related Art

Detachable gunstocks are well known. However, conventional adapters for attaching a detachable stock to the firing mechanism and the barrel of a firearm are not reliable in use. It is often that the firing mechanism and the barrel of a firearm are disengaged from the stock when a law enforcement officer holds a firearm in action.

Thus, the need for improvement still exists.

SUMMARY OF THE INVENTION

It is therefore one object of the invention to provide an adapter comprising a rail having one end secured to a stock; a groove structure comprising a groove on a bottom, a socket at a forward end of the groove, a transverse channel through the socket and both side surfaces of the groove structure, a pin hole through the transverse channel, and a limit member on the bottom of the groove structure; a lever pivotably secured to the groove structure and comprising a handle; and a sliding member disposed in both the transverse channel and the socket and comprising a projection at one end, a shoulder adjacent to the projection, a receptacle at an other end, a biasing member disposed in the receptacle, and a slot perpendicular to the receptacle and communicating therewith; wherein the pin is disposed through the pin hole and the slot to anchor the biasing member between the pin and a blind end of the receptacle; wherein in a locked state, the shoulder is disposed in the socket to lock the rail in the groove, an other end of the sliding member is projected out of the groove structure, the projection is retracted into the channel and is pressed by the handle, and the biasing member is compressed; and wherein in an unlocked state, the handle is stopped by the limit member, the projection is pushed outward by the expanding biasing member with one end of the slot contacting the pin, the shoulder clears the socket, and the rail is unlocked.

The above and other objects, features and advantages of the invention will become apparent from the following detailed description taken with the accompanying drawings.

DETAILED DESCRIPTION OF THE INVENTION

Figure 1:
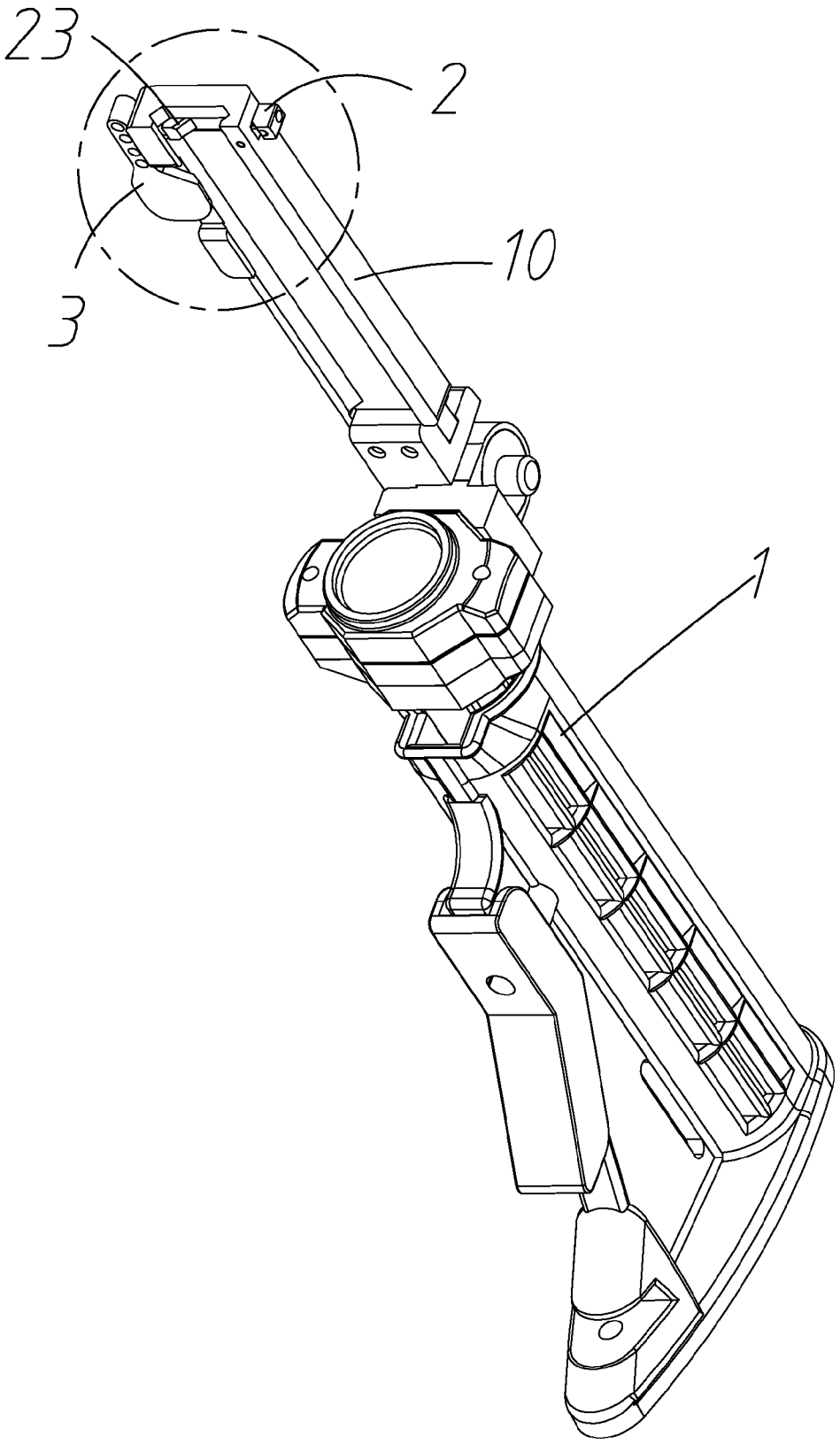
FIG. 1 is a perspective view of an adapter according to the invention mounted to a gunstock.

Referring to FIGS. 1 to 7, an adapter for attaching a detachable stock 1 to the firing mechanism of a firearm in accordance with the invention comprises the following components as discussed in detail below.

A rail 4 has one end attached to the stock 1. A groove structure 10 comprises a bottom groove 11, a socket 13 at the other end (i.e., open end) of the groove 11, a transverse channel 12 through the socket 13 and both side surfaces of the groove structure 10, a pin hole 14 through the channel 12 at the other end of the groove structure 10, a lug 15 at the other end of the groove structure 10 opposite to the hole 14, a hole member 16 through the lug 15, a limit member 17 formed on the bottom of the groove structure 10 adjacent to the lug 15 and opposite to the pin hole 14, and a pin 18.

A lever 3 comprises an enlarged head 36, a handle 31, and a partially threaded pivot 32 inserted through the hole member 16 to be pivotably fastened by a washer 34, a C ring 35, and a nut 33. An elongated sliding member 2 is disposed in the channel 12 and the socket 13 and comprises a cylindrical projection 21 at one end, a shoulder 23 adjacent to the projection 21, a receptacle 24 at the other end, a helical spring 25 disposed in the receptacle 24, and a slot 22 perpendicular to the receptacle 24 and communicating therewith. The pin 18 is driven through the pin hole 14 and the slot 22 to anchor the spring 25 between the pin 18 and a blind end of the receptacle 24.

Figure 2:
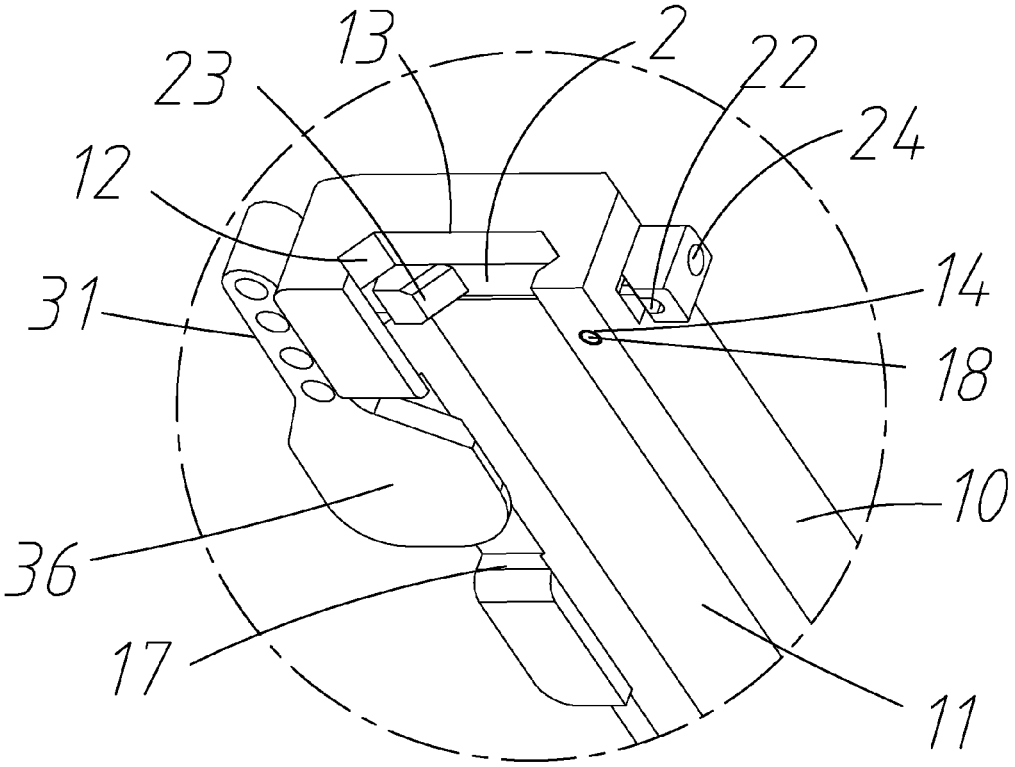
FIG. 2 is a detailed view of the area in a circle of FIG. 1, the adapter being locked.
Figure 5:
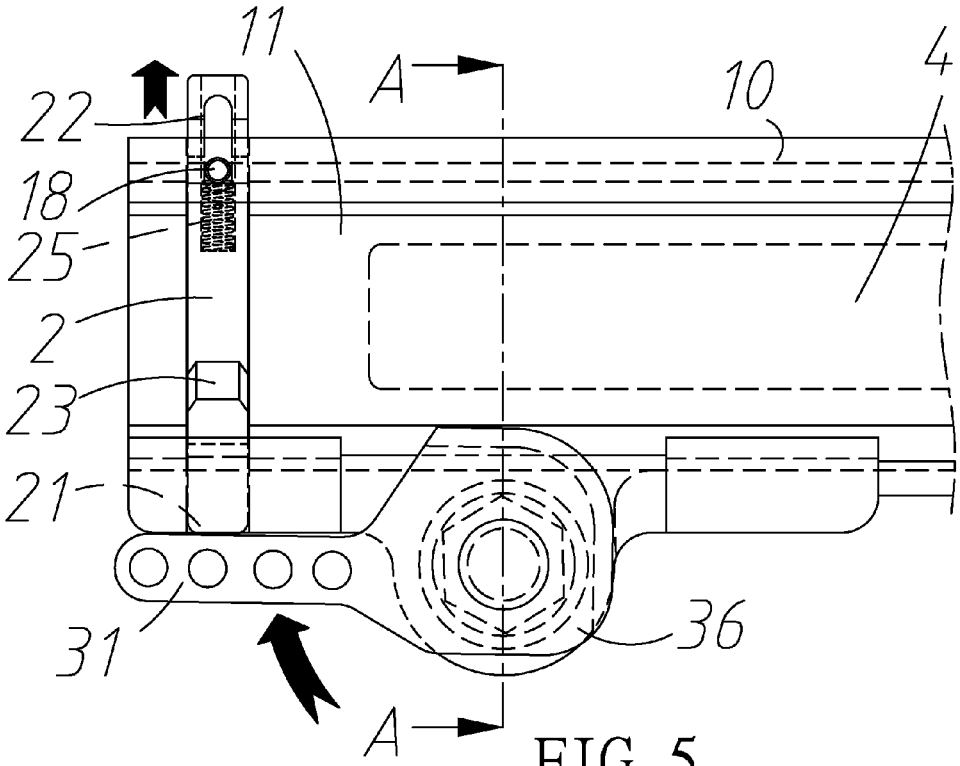
FIG. 5 is a top view of a front portion of the locked adapter shown in FIG. 2.

As shown in FIGS. 2 and 5, in a locked state the shoulder 23 is disposed in the socket 13 to lock the rail 4 disposed in the groove 11. Also, the other end of the sliding member 2 projects out of the other side of the groove structure 10, the projection 21 is retracted into the channel 12 by pivoting the handle 31 to press thereon, and the spring 25 is compressed (i.e., energized).

Figure 3:
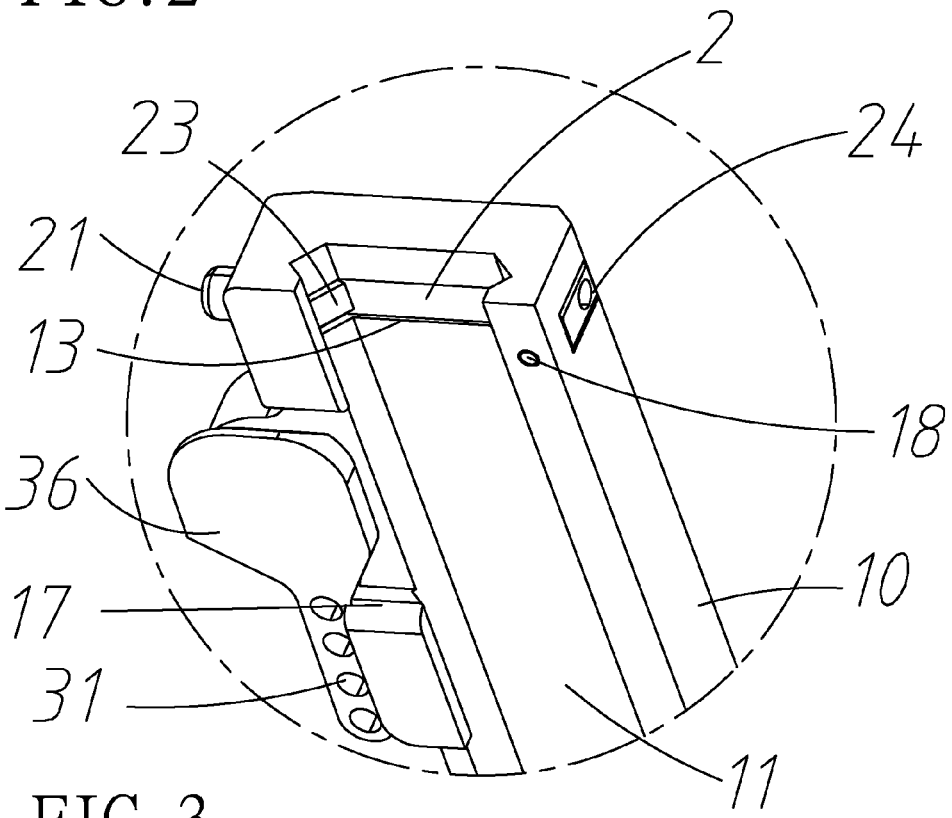
FIG. 3 is a view similar to FIG. 2, the adapter being unlocked.
Figure 4:
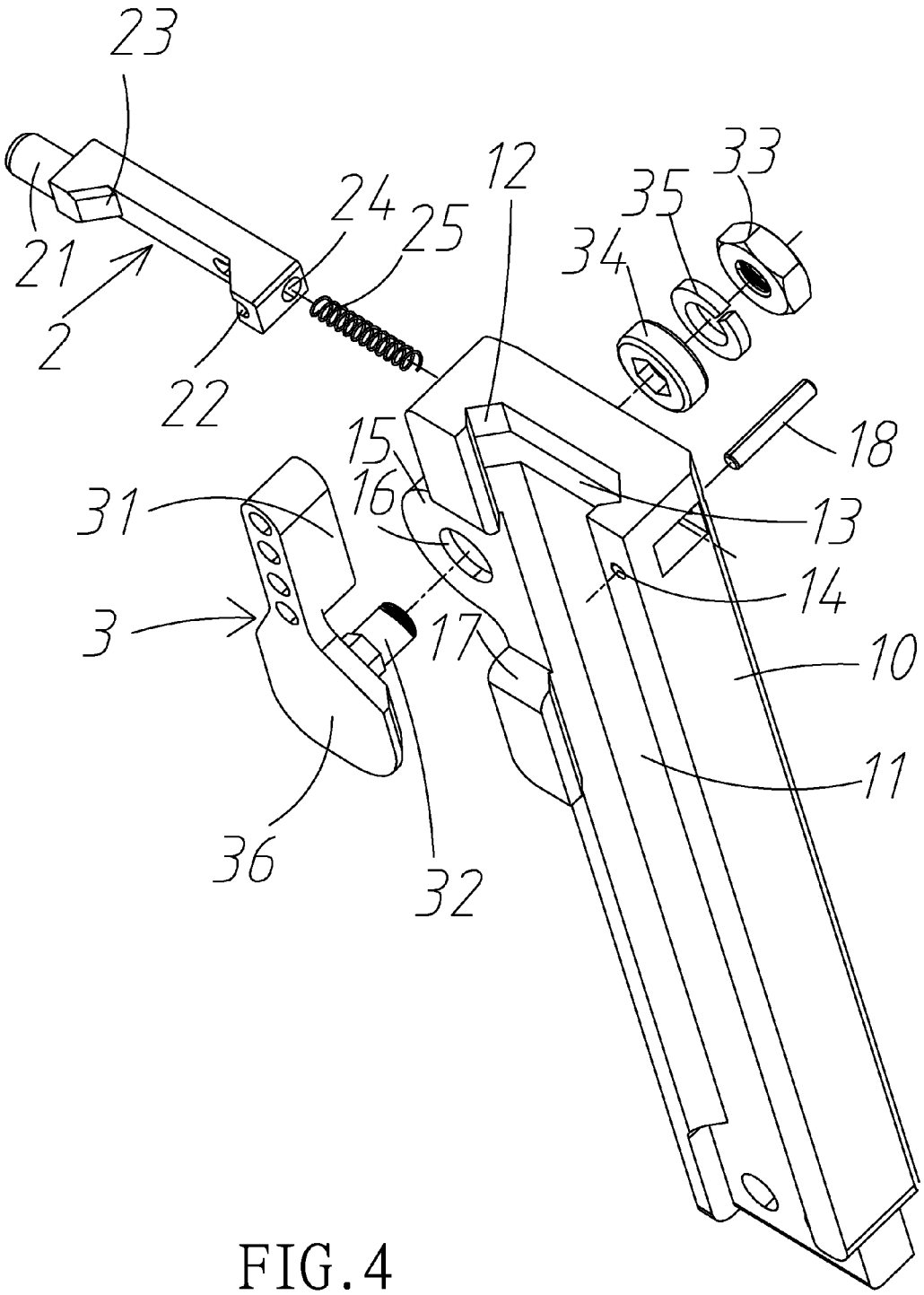
FIG. 4 is an exploded view of the adapter.
Figure 6:
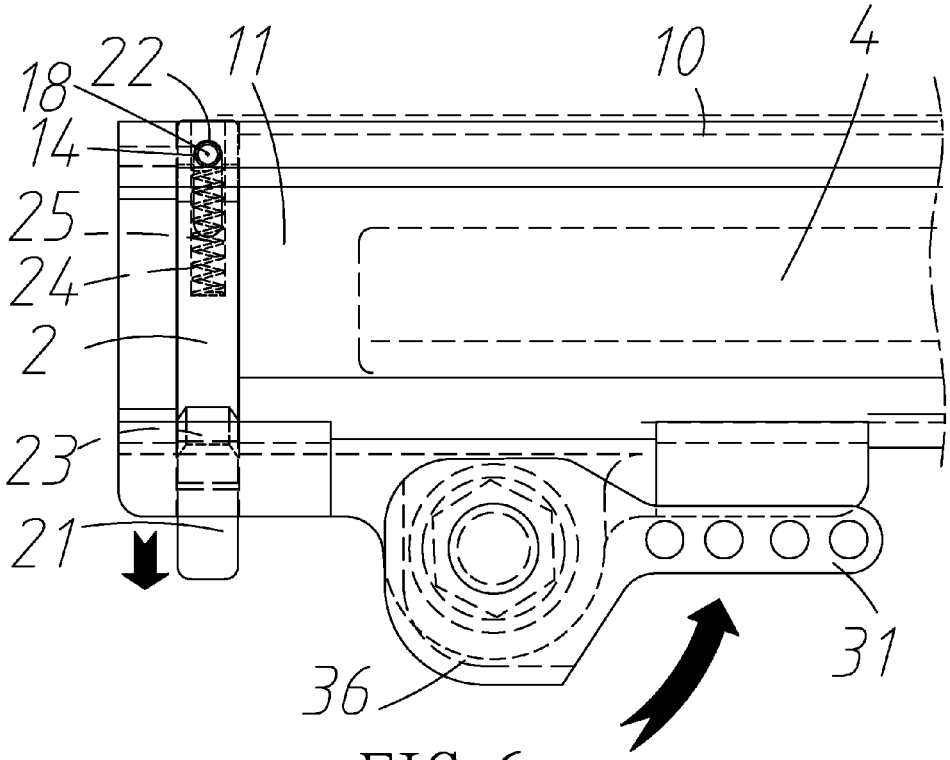
FIG. 6 is a top view of the front portion of the unlocked adapter shown in FIG. 3.
Figure 7:
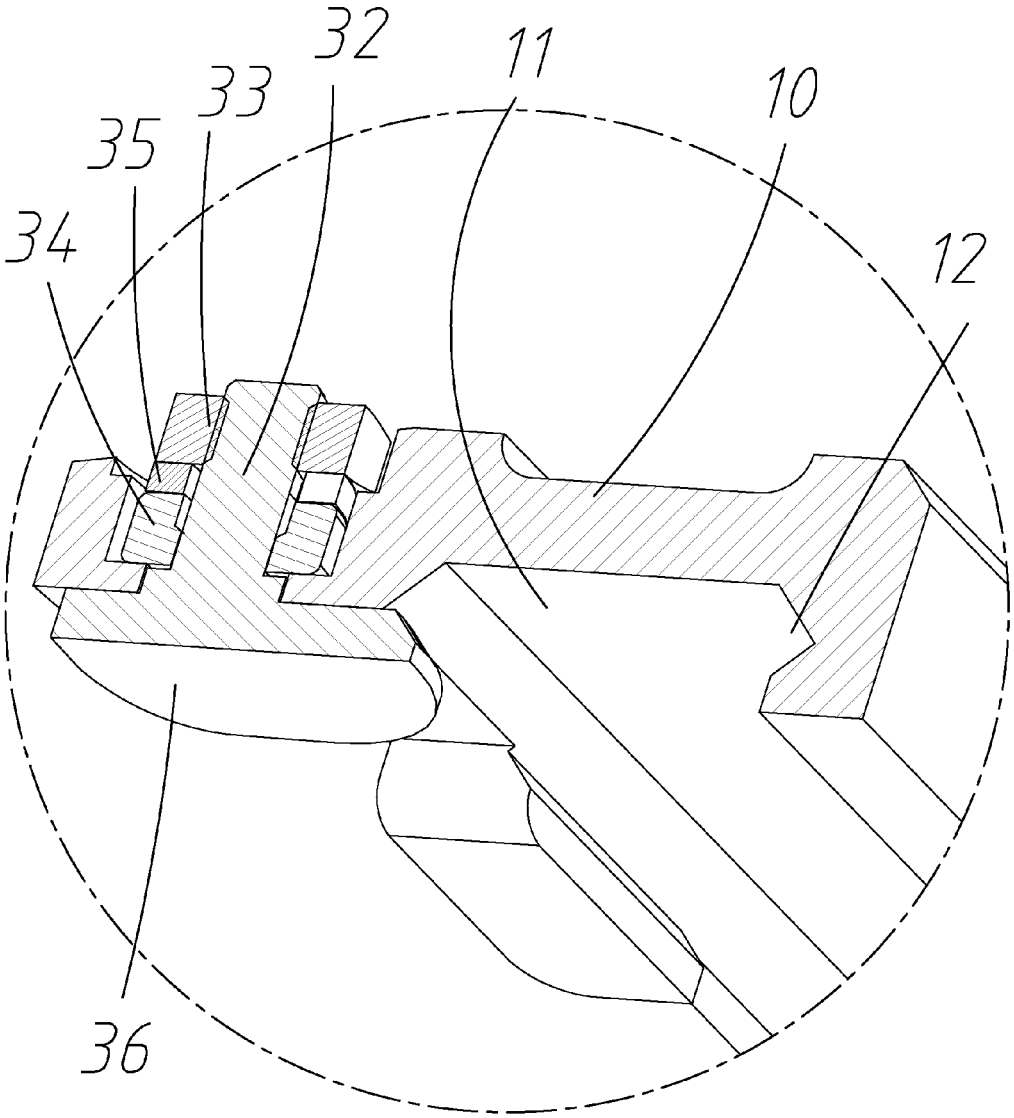
FIG. 7 is a sectional view taken along line A-A of FIG. 5.

As shown in FIGS. 3 and 6, in an unlocking operation, a user may clockwise pivot the handle 31 180-degree until being stopped by the limit member 17, the projection 21 is pushed outward by the expanding spring 25 until one end of the slot 22 contacts the pin 18, and the shoulder 23 clears the socket 13. The rail 4 is unlocked and thus the stock 1 attached to the rail 4 is unlocked. Thereafter, the user may detach the stock 1 from the firing mechanism and the barrel of a firearm.

While the invention has been described in terms of preferred embodiments, those skilled in the art will recognize that the invention can be practiced with modifications within the spirit and scope of the appended claims.

What is claimed is:

1. An adapter comprising:

a rail having one end secured to a stock;

a groove structure comprising a groove on a bottom, a socket at a forward end of the groove, a transverse channel through the socket, a first side surface of the groove structure, and an opposing second side surface of the groove structure, a pin hole through the transverse channel, and a limit member on the bottom of the groove structure;

a lever pivotably secured to the groove structure and comprising a handle; and a sliding member disposed in both the transverse channel and the socket and comprising a projection at one end, a shoulder adjacent to the projection, a receptacle at an other end, a biasing member disposed in the receptacle, and a slot perpendicular to the receptacle and communicating therewith;

wherein a pin is disposed through the pin hole and the slot to anchor the biasing member between the pin and a bottom of the receptacle;

wherein in a locked state, the shoulder is disposed in the socket to lock the rail in the groove, an other end of the sliding member is projected out of the groove structure, the projection is retracted into the channel and is pressed by the handle, and the biasing member is compressed; and wherein in an unlocked state, the handle is stopped by the limit member, the projection is pushed outward by the biasing member with one end of the slot contacting the pin, the shoulder is not disposed in the socket, and the rail is unlocked.

* * * * *